United States Patent [19]

Lotter et al.

[11] Patent Number: 4,546,692

[45] Date of Patent: Oct. 15, 1985

[54] RADIAL BEARING FOR DRIVE PLATE OF INCLINED-AXIS TYPE AXIAL PISTON MACHINE

[75] Inventors: Manfred Lotter, Neu-Ulm; Rainer Stölzer, Ulm, both of Fed. Rep. of Germany

[73] Assignee: Hydromatik GmbH, Elchingen, Fed. Rep. of Germany

[21] Appl. No.: 537,444

[22] Filed: Sep. 30, 1983

[30] Foreign Application Priority Data

Oct. 22, 1982 [DE] Fed. Rep. of Germany ..... 3239175

[51] Int. Cl.[4] ..... F01B 3/00; F01M 1/06

[52] U.S. Cl. ..... 92/12.2; 92/154; 92/159; 91/488; 91/499; 384/121

[58] Field of Search ..... 92/12.2, 154, 157, 159; 91/488, 489, 499; 384/121

[56] References Cited

U.S. PATENT DOCUMENTS

| | | | |
|---|---|---|---|
| 2,155,455 | 4/1939 | Thoma | 91/489 |
| 3,119,639 | 1/1964 | Adams | 384/121 |
| 3,198,130 | 8/1965 | Thoma . | |
| 3,198,131 | 8/1965 | Thoma | 91/489 |
| 4,422,367 | 12/1983 | Berthold | 91/484 |

FOREIGN PATENT DOCUMENTS

| | | | |
|---|---|---|---|
| 2253419 | 5/1974 | Fed. Rep. of Germany | 91/488 |
| 430626 | 8/1967 | Switzerland | 91/488 |
| 1193704 | 6/1970 | United Kingdom | 91/488 |
| 1193705 | 6/1970 | United Kingdom . | |

*Primary Examiner*—Robert E. Garrett
*Assistant Examiner*—Richard S. Meyer
*Attorney, Agent, or Firm*—Lewis H. Eslinger

[57] ABSTRACT

An axial piston machine of the inclined axis type is operable as a pump or motor has a drive shaft, a drive plate rotatable with the drive shaft, a machine housing, a drum having cylindrical bores inclined to the axis of rotation of the drive plate, pistons reciprocally mounted in the bores and connected to the drive plate, and an axial slide bearing and a radial slide bearing arranged in the housing to provide axial and radial support for the drive plate, in which an improved radial slide bearing comprises a circumferentially spaced arrangement of pressure chambers formed in the outer periphery of the drive plate each corresponding to a respective one of the cylindrical bores, the pressure chamber opening outwardly of the drive plate to form a hydrostatic and a hydrodynamic radial slide bearing with an adjacent internal bearing surface of the housing. Each pressure chamber communicates with a respective cylindrical bore and receives a supply of the operating medium of the machine, and is angularly displaced relative to the cylindrical bores so as to follow or precede the cylindrical bore with respect to the direction of rotation of the drive plate in pump operation or in motor operation, respectively.

7 Claims, 2 Drawing Figures

RADIAL BEARING FOR DRIVE PLATE OF INCLINED-AXIS TYPE AXIAL PISTON MACHINE

This invention relates to an axial piston machine of the inclined axis type and operable as a pump or motor, the machine comprising:

a drive shaft which is operable as an input shaft for pump operation and as an output shaft for motor operation of the machine;

a drive plate rotatable with the drive shaft;

a machine housing in which the drive plate is rotatably mounted;

a drum having cylindrical bores and mounted in the housing with the axes of the cylindrical bores inclined to the axis of rotation of the drive plate;

pistons mounted for reciprocating movement in the cylindrical bores and connected to the drive plate;

and an axial slide bearing and a radial slide bearing arranged in the housing to provide axial and radial support for the drive plate.

In the case of the so-called inclined-axis axial piston machines, the pistons arranged in the rotatable cylinder drum act via piston rods on the also rotating drive plate or flange (drive disc), the axis of rotation of the drive flange and the axis of rotation of the cylinder drum forming a specific adjustable or constant angle. The piston rods or respectively piston elements, if the piston and piston rod are formed in one piece, are pivotably borne in the drive flange in a pivot plane, which is perpendicular to the axis of rotation of the drive flange and passes through the point where the axes of rotation of the cylinder and drive flange cross. The effect of the force of the piston rods on the drive flange can be dispersed in this pivot plane into one radial component and one axial component relative to the drive flange. The support for these drive forces is effected mostly by means of various combinations of roller bearings.

Supporting the forces acting in an axial direction on the drive flange is effected in known machines of the type described above by means of slide shoes, which are designed as hydrostatic bearing members, one slide shoe being associated with each piston. The hydrostatic unloading (support) is effected by a pressure chamber, located in the bearing surface of the slide shoe and acted upon by the working pressure via a duct passing through the piston and piston rod (U.S. Pat. No. 3,198,130, GB-PS 1,193,705). The axial component of the forces of each piston can thus be supported directly and almost completely hydrostatically. Remaining axial forces can be taken up hydrodynamically by the slide shoe support surface or a separate axial slide ring.

In order to support the forces acting in a radial direction on the drive flange, there is a radial bearing with a centre of support lying in the pivot plane. Only in this way can tilting forces acting on the drive flange be avoided. The simplest solution for the radial bearing is a hydrodynamically supporting slide bearing, as described for example in U.S. Pat. Nos. 3,198,130 or 3,056,358. In practice, however, it has been shown to be difficult to construct an adequately loadable bearing in view of the limited space proportions (the radial extension of the housing of such an axial piston machine is determined essentially by the radial size of the construction in the area of the drive flange). This applies particularly to operation with fluids having low lubricity. Thus, in GB-PS 1,193,705, slide shoes are provided on the radially loaded side of the drive flange, with pressure chambers acted upon by the working pressure of the operating medium of the axial piston machine, which chambers, as hydrostatic bearings, support a considerable part of the radial forces acting on the drive flange.

This construction, however, has the following disadvantages: The slide shoes must be mounted in the area of the greatest diameter of the drive flange, and thus increase the outer dimension of the axial piston machine. The slide shoes are relatively expensive due to the necessary radial curvature and the pressure supply required from the exterior through the housing. Such a construction, apart from this, is unsuitable for axial piston machines whose angle of inclination, that is, the angle of inclination of the axis of rotation of the cylinder drum relative to the axis of rotation of the drive flange, is adjustable. Changing the angle of pivot also changes the size of the radial components, to be supported by the radial slide bearing, of the forces acting on the drive flange. If the pressure action of the operating medium on the slide shoe were kept constant, the slide shoes of the radial slide bearing would push the drive flange on to the side further away from the load if the angles of pivot of the cylinder drum were small. On the other hand, complete support of the occurring radial forces of the drive flange would not always be guaranteed in the event of large angles of pivot.

The present invention has been developed with a view to provide an improved bearing support for the drive plate of an axial piston machine constructed in the inclined-axis style, to the extent that a bearing support, in particular a radial bearing support of the drive plate, is produced which is automatically adapted to all operating conditions and pivot positions of the cylinder drum in the case of adjustable machines.

According to the invention there is provided an axial piston machine of the inclined axis type and operable as a pump or motor, said machine comprising:

a drive shaft which is operable as an input shaft for pump operation and as an output shaft for motor operation of the machine;

a drive plate rotatable with the drive shaft;

a machine housing in which the drive plate is rotatably mounted;

a drum having cylindrical bores and mounted in the housing with the axes of the cylindrical bores inclined to the axis of rotation of the drive plate;

pistons mounted for reciprocating movement in the cylindrical bores and connected to the drive plate;

and an axial slide bearing and a radial slide bearing arranged in the housing to provide axial and radial support for the drive plate;

wherein the radial slide bearing comprises:

a circumferentially spaced arrangement of pressure chambers formed in the outer periphery of the drive plate and each corresponding to a respective one of the cylindrical bores, said pressure chambers opening outwardly of the drive plate so as to form a hydrostatic and hydrodynamic radial slide bearing with an adjacent internal bearing surface of the housing, and each pressure chamber communicating with its respective cylindrical bore to receive therefrom a supply of operating medium of the machine and being angularly displaced relative to the cylindrical bore in such a way as to follow, or to precede, the cylindrical bore with respect to the direction of rotation of the drive plate in pump operation or motor operation respectively;

and means communicating each cylindrical bore with its respective pressure chamber comprising a through-passage formed in the associated piston and a respective passage in the drive plate communicating said through-passage with the pressure chamber.

In embodiments of axial piston machine according to the invention, it is possible to ensure that the pressure chambers act upon the active area of radial load, and react automatically and precisely to changes in the level of load by changing the angle of pivot or the operating pressure. A hydrostatic pressure is established in the pressure chambers, which is higher, the smaller lubrication slot being arranged between the outer periphery of the drive plate and the cylindrical bearing surface of the housing (or optionally an intermediate bearing sleeve). The pressure fluid forming off into the pressure chambers serves directly to build up a hydrodynamic film of lubrication on the cylindrical bearing surface. The hydrodynamic slide bearing effect is thereby assisted to a considerable extent and any contact of metals is avoided even in transitional operating conditions, for example when the machine is started up.

In a preferred embodiment, the axial slide bearing is a hydrostatic bearing comprising further pressure chambers arranged in an end face of the drive plate and each corresponding to a respective one of the cylindrical bores, axially movable slide shoes arranged in said further pressure chambers, through-passages formed in the slide shoes, and internal chambers formed in the drive plate and communicating with the cylindrical bores via the through-passages in the pistons and also communicating with the through-passages in the slide shoes. Each internal chamber communicates with a respective one of the pressure chambers in the outer periphery of the drive plate by means of a respective outwardly extending connecting duct formed in the drive plate.

In the preferred embodiment, the radial and axial bearing support of the drive plate takes full account of the force pulsating with the changing number of pressure-loaded systems. If the radial force acts on the drive plate and decreases as the angle of pivot of the drum reduces, the pressure in the pressure chambers drops as the lubrication slot increases, so that the danger of the drive plate approaching the side further away from the load does not exist. An axial piston machine according to the invention ensures a good supply of fluid to the radial slide bearing for the necessary formation of a hydrodynamic lubrication film and also hydrostatic unloading of the drive plate dependent on the width of the lubricated slot.

DESCRIPTION OF PREFERRED EMBODIMENT

Figure 2:
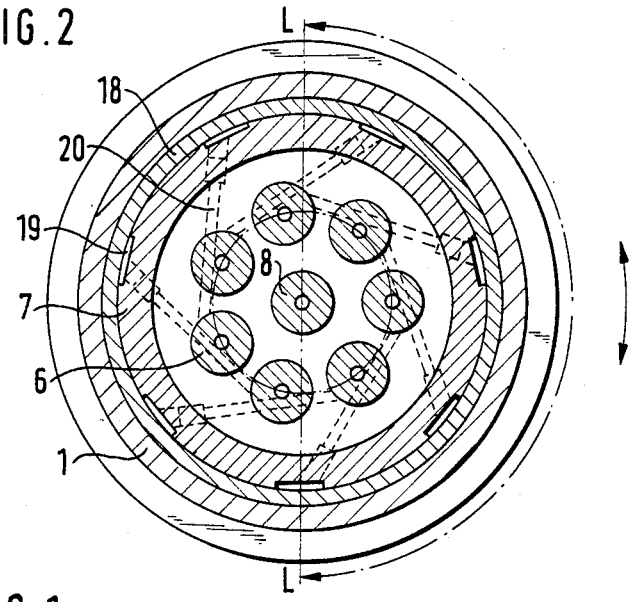
FIG. 2 is a section along the line A—A in FIG. 1.

The axial piston machine comprises a housing 1 with a housing cover 2, a cylindrical drum 3 with cylinder bores 4, and pistons 5 movable back and forth in the cylinder bores 4 and secured to piston rods 6 which in turn are pivotably mounted in a drive flange 7 (swash plate). The drum 3 is rotatably mounted by means of a pin 8, which is also pivotably mounted on the drive flange 7, and is supported on a control mirror body (convex body) 9. An unshown adjusting device for changing the angle of inclination of the cylinder drum 3 acts upon the control body 9. By changing the angle of inclination, the stroke of the piston 5 in the cylinder bores 4 changes also.

The drive flange 7 is connected to a shaft 10, which acts as a input or output shaft according to the method of operation of the axial piston machine i.e. pump or motor operation respectively. The drive flange 7 contains internal chambers 11, in which slide shoes 12 are arranged in such a manner as to be axially displaceable relative to the shaft 10. The slide shoes 12 abut a bearing disc 13 and together with this form an axial bearing for the drive flange 7. The slide shoes 12 form the pressure chambers 14, each which is connected to the respective chamber 11 via a bore or through-passage 15. The chamber 11 in turn is connected via a duct 16 to a central duct or through-passage 17 in the piston rod 6 and the piston 5 of the associated piston element. The pressure of the operating medium located in each case in the cylindrical bore 4 in front of the piston 5 is thus fed in each case to the corresponding pressure chamber 14.

The outer peripheral surface of the drive flange 7 forms a radial slide bearing, on which is fitted a bearing sleeve 18 arranged in the housing 1. Pressure chambers 19 distributed over the periphery and corresponding to the number of pistons 5 are provided on the outer peripheral surface of the drive flange 7. As can be seen from FIG. 2, each of the pressure chambers 19 is connected via a further connecting duct 20 to one of the chambers 11 of one of the slide shoes 12. However, it should be noted that each pressure chamber 19 is not connected to the chamber 11 associated with the next piston 5, but to a chamber 11 displaced by a certain angle of rotation. There is located in each connecting duct 20 a throttle point 21, whose size can determine the amount of lubrication and cooling for the radial bearing. Thus, each pressure chamber 19 communicates with its respective cylindrical bore 4 so as to be pressurised by the operating medium of the machine by means of a through-passage (17) in the associated piston (5, 6) and a communicating passage (16, 11, 20) formed in the drive flange 7.

As can be seen, each pressure chamber 19 is angularly displaced by an angle of rotation of the drive flange 7 of approx. 90° relative to the associated chamber 11 and therefore to the associated piston element 5, 6 and cylindrical bore 4. As indicated in FIG. 2, each pressure chamber 19 is displaced relative to the associated piston element so as to follow it for pump operation, and so as to precede it for motor operation. In this way, a continuous supply of pressure medium to the load area L—L of the radial bearing is achieved in every operating condition.

Figure 1:
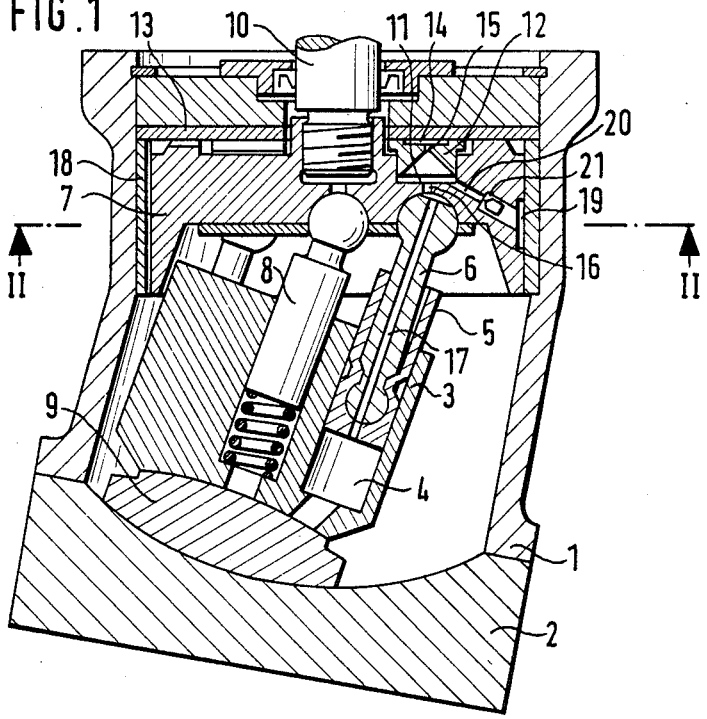
FIG. 1 is a schematic sectional illustration of an embodiment of an axial piston machine in accordance with the invention.

In FIG. 1, parts 19, 20, 21 are shown displaced in the direction of rotation for clarification. The actual position of these parts in the drive flange 7 can be seen in FIG. 2.

We claim:

1. An axial piston machine of the inclined axis type and operable as a pump or motor, said machine comprising:

a drive shaft which is operable as an input shaft for pump operation and as an output shaft for motor operation of the machine;

a drive plate rotatable with the drive shaft;

a machine housing in which the drive plate is rotatably mounted;

a drum having cylindrical bores and mounted in the housing with the axes of the cylindrical bores inclined to the axis of rotation of the drive plate;

pistons mounted for reciprocating movement in the cylindrical bores and connected to the drive plate;

and an axial slide bearing and a radial slide bearing arranged in the housing to provide axial and radial support for the drive plate;

wherein the radial slide bearing comprises:

a circumferentially spaced arrangement of pressure chambers corresponding in number to the number of pistons and formed in the outer periphery of the drive plate and each corresponding to a respective one of the cylindrical bores, said pressure chambers opening outwardly of the drive plate so as to form a hydrostatic and hydrodynamic radial slide bearing with an adjacent internal bearing surface of the housing, and each pressure chamber communicating with its respective cylindrical bore to receive therefrom a supply of operating medium of the machine and being angularly displaced relative to the cylindrical bore in such a way as to follow, or to precede, the cylindrical bore with respect to the direction of rotation of the drive plate in pump operation or motor operation, respectively;

wherein each pressure chamber is angularly displaced from its respective cylindrical bore and associated piston by about 90° with respect to the axis of rotation of the drive plate;

and means for fluid communicating each cylindrical bore with its respective pressure chamber comprising a through-passage formed in the associated piston and a respective passage in the drive plate communicating said through-passage with the pressure chamber.

2. An axial piston machine according to claim 1, including a bearing sleeve arranged between said pressure chambers and said internal bearing surface of the housing.

3. An axial piston machine according to claim 1, including control body means affixed to said drum and adapted for use in adjusting the inclination of the drum relative to the drive plate.

4. An axial piston machine according to claim 1, wherein the axial slide bearing is a hydrostatic bearing comprising further pressure chambers arranged in an end face of the drive plate and each corresponding to a respective one of the cylindrical bores, axially movable slide shoes arranged in said further pressure chambers, through-passages formed in slide shoes, and internal chambers formed in the drive plate and communicating with the cylindrical bores via the through-passages in the pistons and also communicating with the through-passages in the slide shoes.

5. An axial piston machine according to claim 4, including a bearing disc arranged adjacent to the drive plate to be engageable by the slide shoes to form the axial slide bearing.

6. An axial piston machine according to claim 4, wherein each internal chamber communicates with a respective one of the pressure chambers in the outer periphery of the drive plate by means of a respective outwardly extending connecting duct formed in the drive plate.

7. An axial piston machine according to claim 6, including a throttle arranged in each connecting duct.

* * * * *